US010651574B2

(12) United States Patent
Maroney et al.

(10) Patent No.: US 10,651,574 B2
(45) Date of Patent: May 12, 2020

(54) COAXIAL CABLE CONNECTORS HAVING PORT GROUNDING

(71) Applicant: PPC Broadband, Inc., East Syracuse, NY (US)

(72) Inventors: Richard Maroney, Camillus, NY (US); Harold Watkins, Chittenango, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/382,171

(22) Filed: Apr. 11, 2019

(65) Prior Publication Data

US 2019/0288410 A1 Sep. 19, 2019

Related U.S. Application Data

(63) Continuation-in-part of application No. 16/355,701, filed on Mar. 15, 2019.

(60) Provisional application No. 62/643,192, filed on Mar. 15, 2018, provisional application No. 62/656,103, filed on Apr. 11, 2018.

(51) Int. Cl.

| | |
|---|---|
| ***H01R 9/05*** | (2006.01) |
| ***H01R 13/622*** | (2006.01) |
| ***H01R 24/40*** | (2011.01) |
| ***H01R 13/502*** | (2006.01) |
| *H01R 103/00* | (2006.01) |

(52) U.S. Cl.

CPC ..... *H01R 9/0524* (2013.01); *H01R 9/0521* (2013.01); *H01R 13/502* (2013.01); *H01R 13/622* (2013.01); *H01R 24/40* (2013.01); *H01R 2103/00* (2013.01)

(58) Field of Classification Search

CPC .... H01R 17/12; H01R 9/0521; H01R 102/00; H01R 9/0512; H01R 12/622

USPC ..... 439/578, 563, 584, 585, 321

See application file for complete search history.

(56) References Cited

U.S. PATENT DOCUMENTS

| | | | | |
|---|---|---|---|---|
| 8,192,237 | B2 * | 6/2012 | Purdy | H01R 24/40 |
| 8,506,325 | B2 * | 8/2013 | Malloy | H01R 13/187 439/578 |
| 2011/0230089 | A1 | 9/2011 | Amidon et al. | |
| 2012/0171894 | A1 | 7/2012 | Malloy et al. | |

(Continued)

OTHER PUBLICATIONS

Jun. 11, 2019 International Search Report and Written Opinion issued in International Application No. PCT/US19/22641.

*Primary Examiner* — Phuong Chi Thi Nguyen

(74) *Attorney, Agent, or Firm* — MH2 Technology Law Group, LLP

(57) ABSTRACT

A coaxial cable connector includes a body configured to engage a coaxial cable having a conductive electrical grounding property, a post configured to engage the body and the coaxial cable when the connector is installed on the coaxial cable, a nut assembly configured to engage an interface port at a first retention force, and a conductive insert configured to be coupled with the nut assembly. The conductive insert is configured to engage the interface port at a second retention force that is greater than the first retention force, and the conductive insert is configured to maintain electrical contact between the interface port and the nut assembly, even when the nut assembly is in a loosely tightened position on the interface port.

20 Claims, 14 Drawing Sheets

(56) References Cited

U.S. PATENT DOCUMENTS

| | | | |
|---|---|---|---|
| 2013/0149896 | A1 | 6/2013 | Holland et al. |
| 2013/0323967 | A1 | 12/2013 | Wood |

* cited by examiner

COAXIAL CABLE CONNECTORS HAVING PORT GROUNDING

CROSS-REFERENCE TO RELATED APPLICATION

This is a continuation-in-part of U.S. patent application Ser. No. 16/355,701, filed on Mar. 15, 2019, pending, which claims the benefit of U.S. Provisional Application No. 62/643,192, filed Mar. 15, 2018, the disclosures of which are incorporated herein by reference in their entirety. This application also claims the benefit of U.S. Provisional Application No. 62/656,103, filed Apr. 11, 2018, the disclosure of which is incorporated herein by reference in its entirety.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port.

However, often connectors are not fully and/or properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port. In particular, in order to allow the threaded nut of a connector to rotate relative to the threaded interface port, sufficient clearance must exist between the matching male and female threads. When the connector is left loose on the interface port (i.e., not fully and/or properly tightened), gaps may still exist between surfaces of the mating male and female threads, thus creating a break in the electrical connection of ground.

Lack of continuous port grounding in a conventional threaded connector, for example, when the conventional threaded connector is loosely coupled with an interface port (i.e., when in a loose state relative to the interface port), introduces noise and ultimately performance degradation in conventional RF systems. Furthermore, lack of ground contact prior to the center conductor contacting the interface port may also introduce an undesirable "burst" of noise upon insertion of the center conductor into the interface port.

Accordingly, there is a need to overcome, or otherwise lessen the effects of, the disadvantages and shortcomings described above. Hence a need exists for a coaxial cable connector having improved grounding between the coaxial cable, the connector, and the coaxial cable connector interface port.

SUMMARY

According to various aspects of the disclosure, a coaxial cable connector includes a body configured to engage a coaxial cable having a conductive electrical grounding property, a post configured to engage the body and the coaxial cable when the connector is installed on the coaxial cable, a nut assembly configured to engage an interface port at a first retention force, and a conductive insert configured to be coupled with the nut assembly. The conductive insert is configured to engage the interface port at a second retention force that is greater than the first retention force, and the conductive insert is configured to maintain electrical contact between the interface port and the nut assembly, even when the nut assembly is in a loosely tightened position on the interface port.

BRIEF DESCRIPTION OF THE DRAWINGS

Features and advantages of the present disclosure are described in, and will be apparent from, the following Brief Description of the Drawings and Detailed Description.

DETAILED DESCRIPTION OF EMBODIMENTS

The accompanying figures illustrate various exemplary embodiments of coaxial cable connectors that provide improved grounding between the coaxial cable, the connector, and the coaxial cable connector interface port. Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
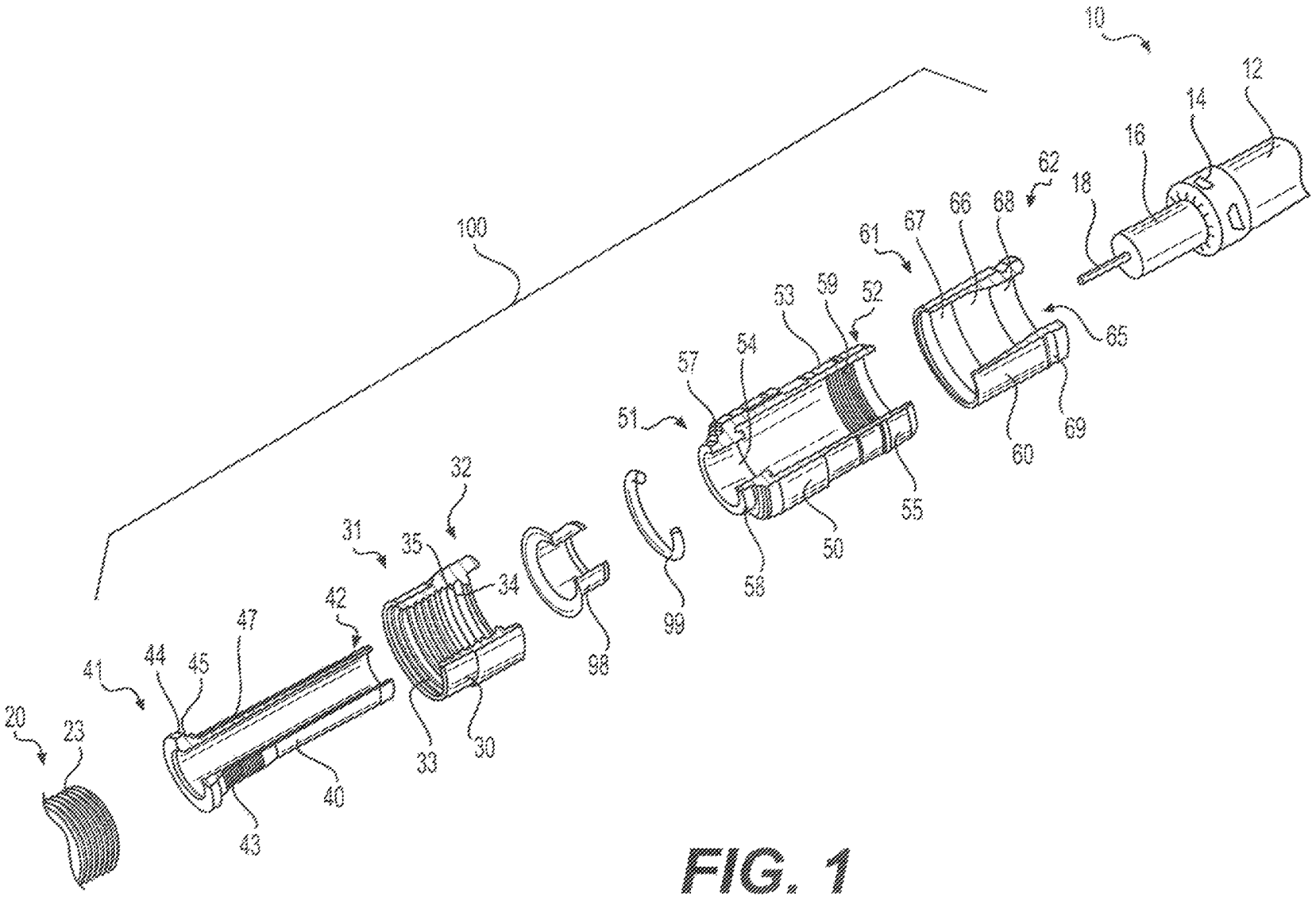
FIG. 1 (PRIOR ART)
FIG. 1 is an exploded perspective cut-away view of a conventional coaxial cable connector.

Referring to the drawings, FIG. 1 depicts a conventional coaxial cable connector 100. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, the conventional coaxial cable connector 100 may include a coupler, for example, threaded nut 30, a post 40, a connector body 50, a fastener member 60, a grounding member 98 formed of conductive material, and a connector body sealing member 99, such as, for example, a body O-ring configured to fit around a portion of the connector body 50. The nut 30 at the front end of the post 40 serves to attach the connector 100 to an interface port.

The threaded nut 30 of the coaxial cable connector 100 has a first forward end 31 and opposing second rearward end 32. The threaded nut 30 may comprise internal threading 33 extending axially from the edge of first forward end 31 a distance sufficient to provide operably effective threadable contact with the external threads 23 of the standard coaxial cable interface port 20. The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according to differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with the interface port 20. Moreover, the second rearward end 32 of the nut 30 may extend a significant axial distance to reside radially extent, or otherwise partially surround, a portion of the connector body 50, although the extended portion of the nut 30 need not contact the connector body 50. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example, the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 of the post 40 when operably assembled in a connector 100, so as to allow the nut to rotate with respect to the other component elements, such as the post 40 and the connector body 50, of the connector 100.

Referring still to FIG. 1, the connector 100 may include a post 40. The post 40 may include a first forward end 41 and an opposing second rearward end 42. Furthermore, the post 40 may include a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a grounding member 98 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of the interface port 20. The post 40 should be formed such that portions of a prepared coaxial cable 10 including the dielectric 16 and center conductor 18 may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

The coaxial cable connector 100 may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of the grounding member 98 with respect to the connector body 50 and/or the post 40, by physically engaging the grounding member 98 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of the electrical grounding member 98 with respect to the connector body 50. Nevertheless, embodiments of the grounding member 98 may also reside in a secure position with respect to the connector body 50 simply through press-fitting and friction-fitting forces engendered by corresponding tolerances, when the various coaxial cable connector 100 components are operably assembled, or otherwise physically aligned and attached together. Various exemplary grounding members are illustrated and described in U.S. Pat. No. 8,287,320, the disclosure of which is incorporated herein by reference. In addition, the connector body 50 may include an outer annular recess 58 located proximate or near the first end 51 of the connector body 50. Furthermore, the connector body 50 may include a semi-rigid, yet compliant outer surface 55, wherein an inner surface opposing the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof.

Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, the coaxial cable connector 100 may include a fastener member 60. The fastener member 60 may have a first end 61 and opposing second end 62. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a common CMP-type connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50.

Figure 2:
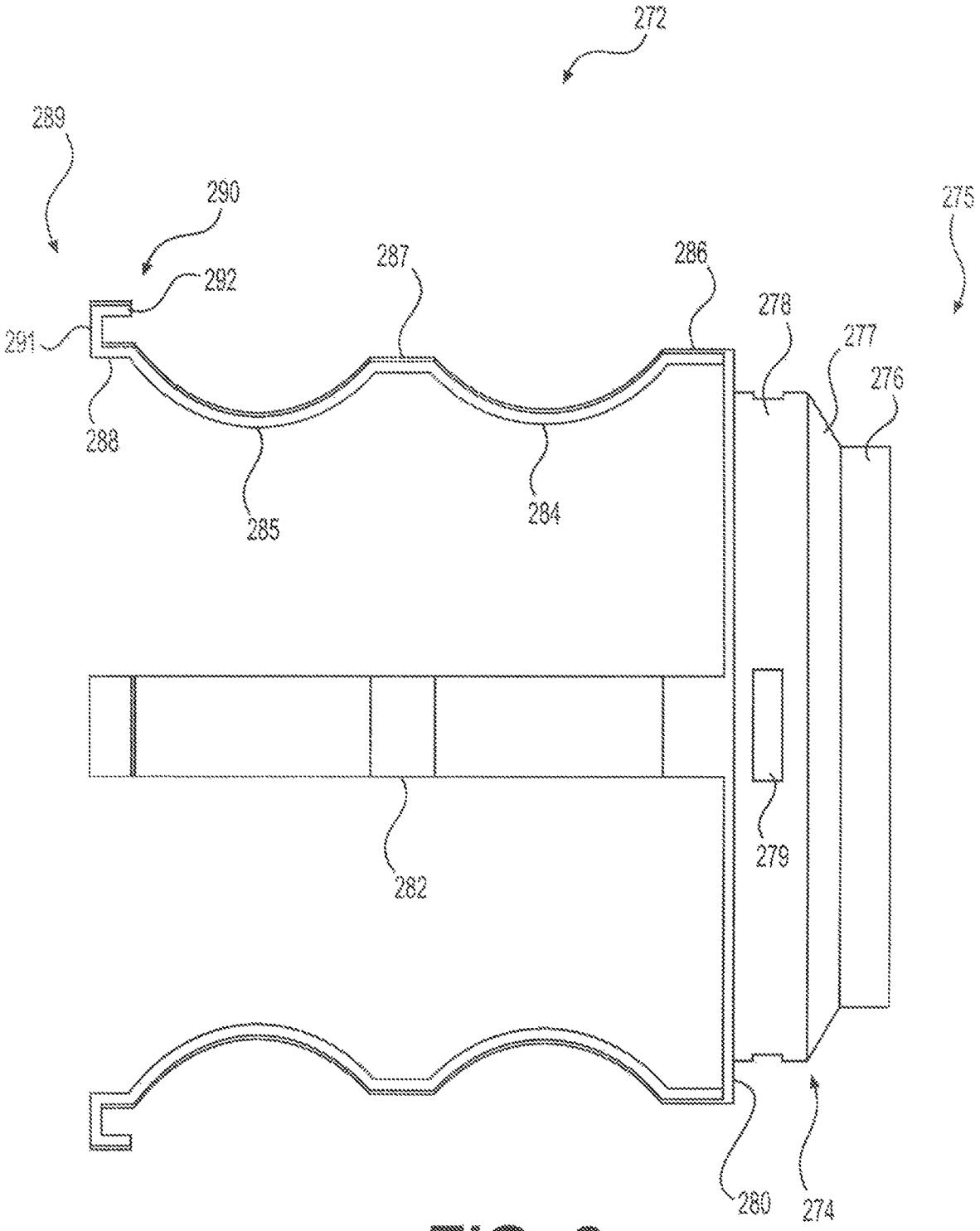
FIG. 2 is a side view of an exemplary conductive insert in accordance with various aspects of the disclosure.
Figure 3:
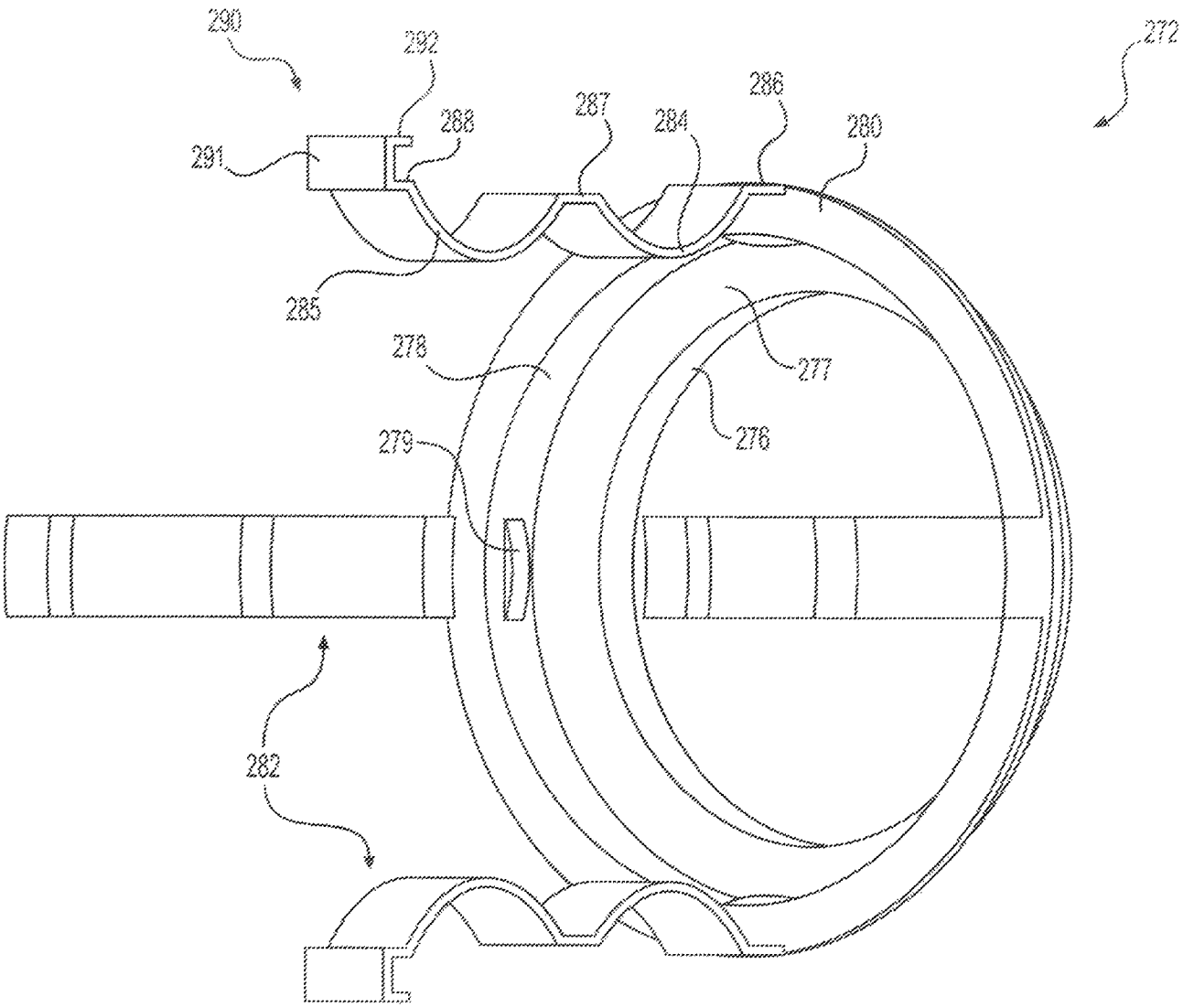
FIG. 3 is a side-front perspective view of the conductive insert of FIG. 2.
Figure 4:
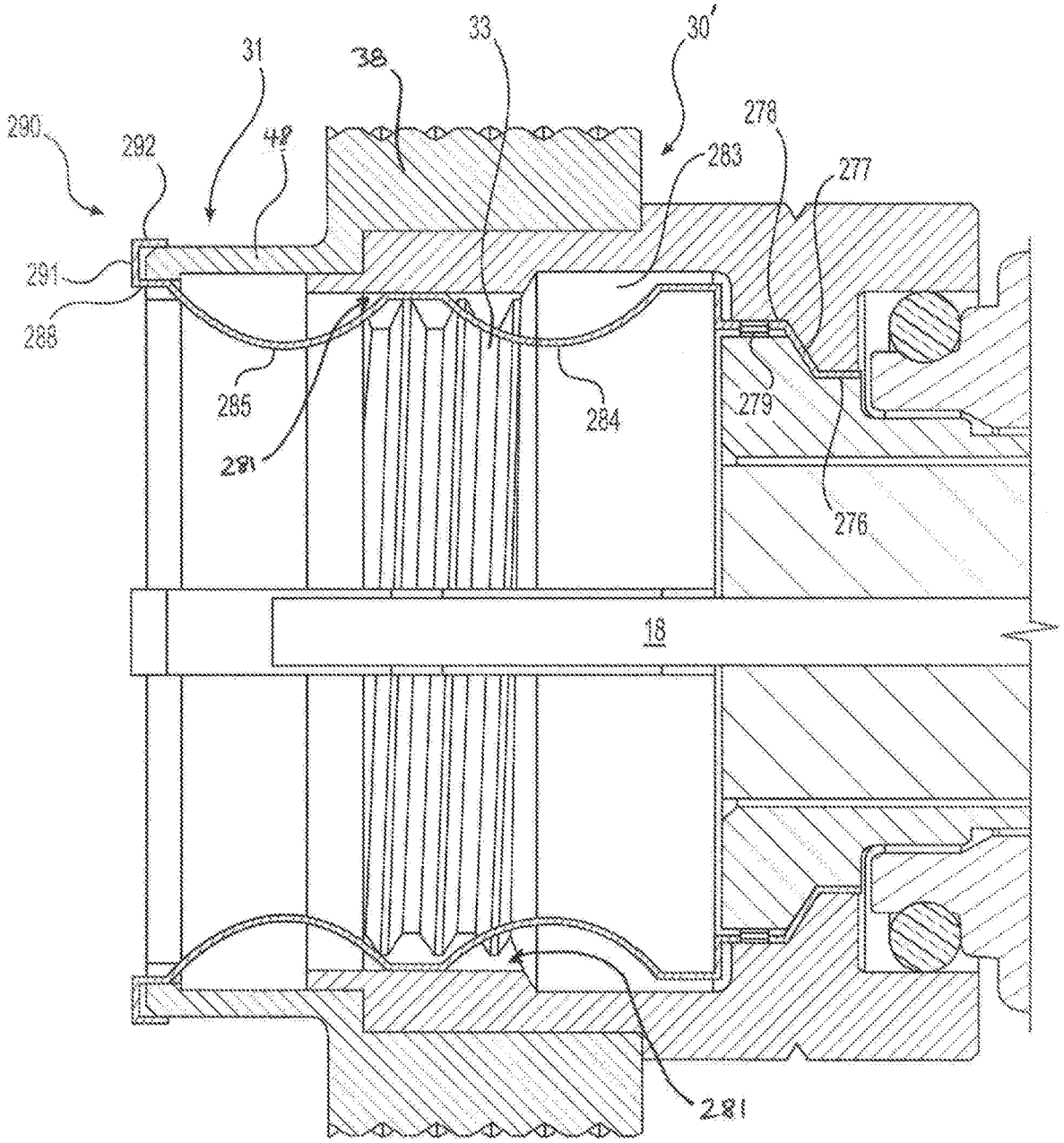
FIG. 4 is a side cross-sectional view of the conductive insert of FIG. 2 coupled with a coaxial connector.

Referring now to FIGS. 2-5, an exemplary conductive insert 272 in accordance with various aspects of the disclosure is illustrated. As shown in FIG. 2, the conductive insert 272 may have an annular ring-like portion 274 at a first end 275 that is shaped to match an inner profile of the lip 34 of the nut 30 and an outer profile of the flange 44 of the post 40. As shown in FIG. 4, the nut 30 is a portion of a nut assembly 30' that includes a nut cap 38. The nut cap 38 can be press fit on the nut 30 such that the nut 30 and the nut cap 38 are configured to rotate together. In some aspects, the nut cap 38 is integrally formed with the nut 30 as a single monolithic structure. The nut cap 38 may include an outer surface that is knurled or otherwise modified to facilitate gripping by a user. In some aspects, the nut cap 38 may be surrounded by a rubber gripping portion.

The annular portion 274 may include a small diameter portion 276, a large diameter portion 278, and a transition portion 277 connecting the large diameter portion 278 with the small diameter portion 276. When installed with a connector, the small diameter portion 276 may be disposed between a radially inward facing surface of the lip 34 of the nut 30 and a radially outward facing surface of the post 40, and the large diameter portion 278 may be disposed between a radially inward facing surface of the nut 30 and a radially outward facing surface of the flange 44 of the post 40. Meanwhile, the transition portion 277 is between the forward facing surface 35 of the lip 34 of the nut 30 and the rearward facing surface 45 of the flange 44.

As best illustrated in FIG. 3, the large diameter portion 278 may include one or more resilient tabs 279 that are cut from the large diameter portion 278 and bend radially inward. For example, the tabs 279 remain connected to the large diameter portion 278 at their circumferential ends, but are separated from the large diameter portion 278 along their circumferential lengths. The tabs 279 are resilient such that when the large diameter portion 278 is disposed between a radially inward facing surface of the nut 30 and a radially outward facing surface of the flange 44 of the post 40, the tabs 279 provide a radial force against the radially outward facing surface of the flange 44, which urges the large diameter portion 278 radially outward against the radially inward surface of the nut 30.

A hoop portion 280 extends radially outward from an end of the large diameter portion 278 that is opposite to the transition portion 277. One or more fingers 282 extend from the hoop portion 280 in an axial direction away from the annular portion 274. According to various aspects of the disclosure, each of the fingers 282 includes two curved portions 284, 285 that curve radially inward from radially outermost portions 286, 287, 288 of the fingers 282. For example, in the illustrated embodiment, the first radially outermost portion 286 extends from the hoop portion 280 in the axial direction, and the first curved portion 284 extends from the first outermost portion 286 to the second radially outermost portion 287. The second curved portion 285 extends from the second outermost portion 287 to the third radially outermost portion 288.

Figure 5:
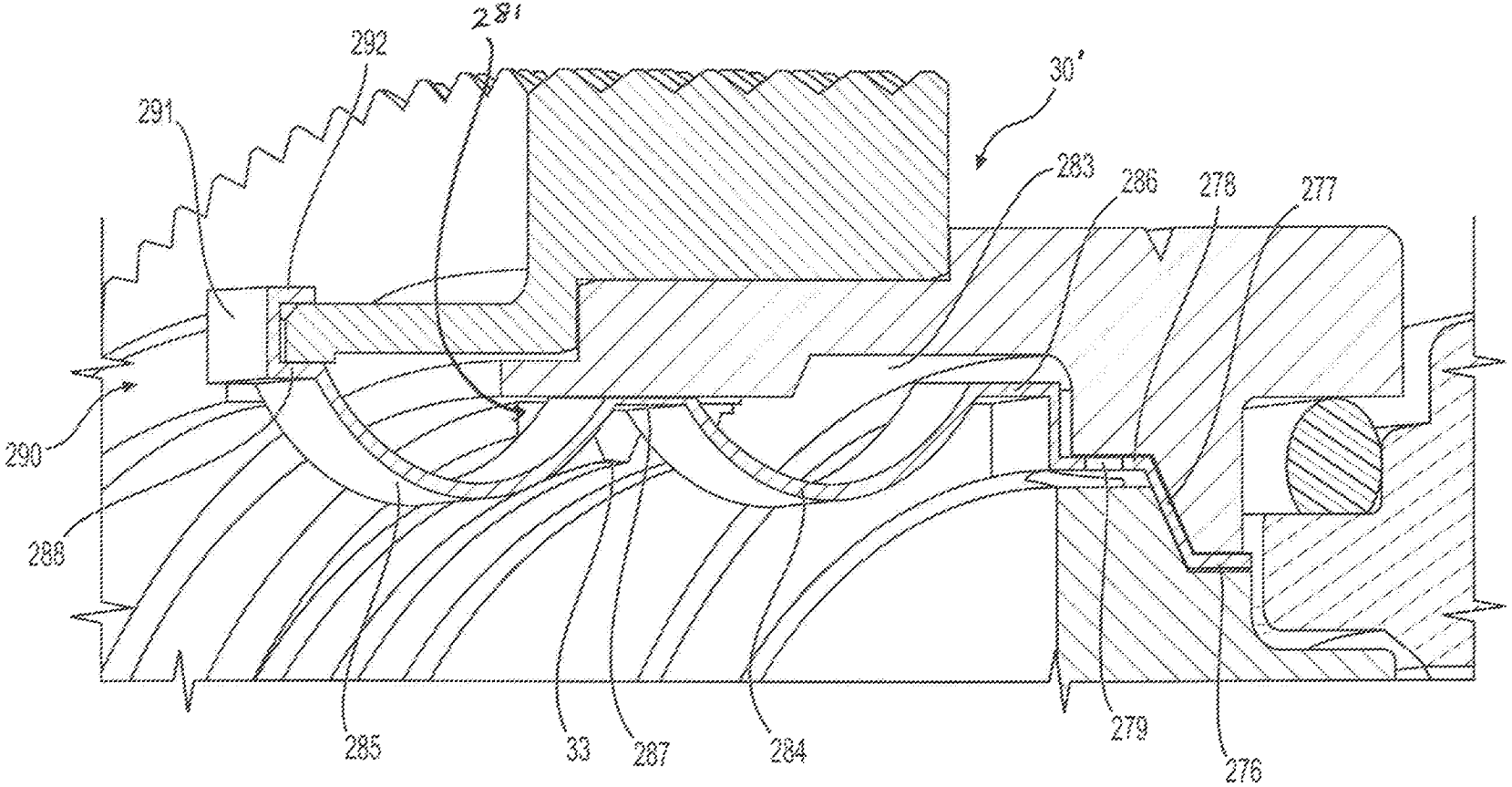
FIG. 5 is a side-front perspective cross-sectional view of the conductive insert of FIG. 2 coupled with a coaxial connector.

A second end 289 of the conductive insert 272 includes a securing portion 290 formed by a radially extending portion 291 and an axially extending portion 292 that extends in the axial direction from the radially extending portion 291 toward the first end 275 of the conductive insert 272. With reference to FIGS. 4 and 5, the each finger 282 is sized and arranged such that the third radially outermost portion 288 can extend beyond the forward end 31 of the nut assembly 30'. The radially extending portion 291 is structured and arranged to extend beyond an outer diameter of the forward end 31 of the nut assembly 30', and the axially extending portion 292 wraps back over the forward end 31 of the nut assembly 30'.

When assembled with a connector, for example, the connector 100, the first end 275 of the conductive insert 272 is secured to the nut assembly 30' and the post 40 by the matching profiles of the conductive insert 272, the nut assembly 30', and the post 40. The fingers 282 are secured to the forward end 31 of the nut assembly 30' by the securing portion 290. The nut assembly 30' includes one or more grooves 281, for example, one or more axial grooves, that are each configured to receive the second radially outermost portion 287 of one of the fingers 282. The securing portion 290 is configured to restrict axial movement of the fingers 282 relative to the nut assembly 30', while each of the one or more grooves 281 is configured to restrict rotation of one of the fingers 282 relative to the nut assembly 30'. In some aspects, the one or more grooves 281 may be circumferential grooves.

The first and second curved portions 284, 285 are structured and arranged to extend radially inward beyond threads of the internal threading 33 of the nut 30. Thus, when coupled with the threaded exterior surface 23 of the coaxial cable interface port 20, the first and second curved portions 284, 285 promote redundant contact, higher retention forces, and continuous grounding from the interface port 20 through to the post 40, even when loosely connected (i.e., not fully tightened) to the interface port 20.

Referring again to FIG. 4, the nut 30 may include a recess 283 arranged to receive a portion of the fingers 282 that may be pushed radially outward when the nut 30 is coupled with the interface port 20. Also, nut cap 38 may include an extension portion 48 that extends forward relative to the internal threading 33 of the nut 30 and relative to a forward end of the center conductor 18. As a result, the second curved portion 285 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 6:
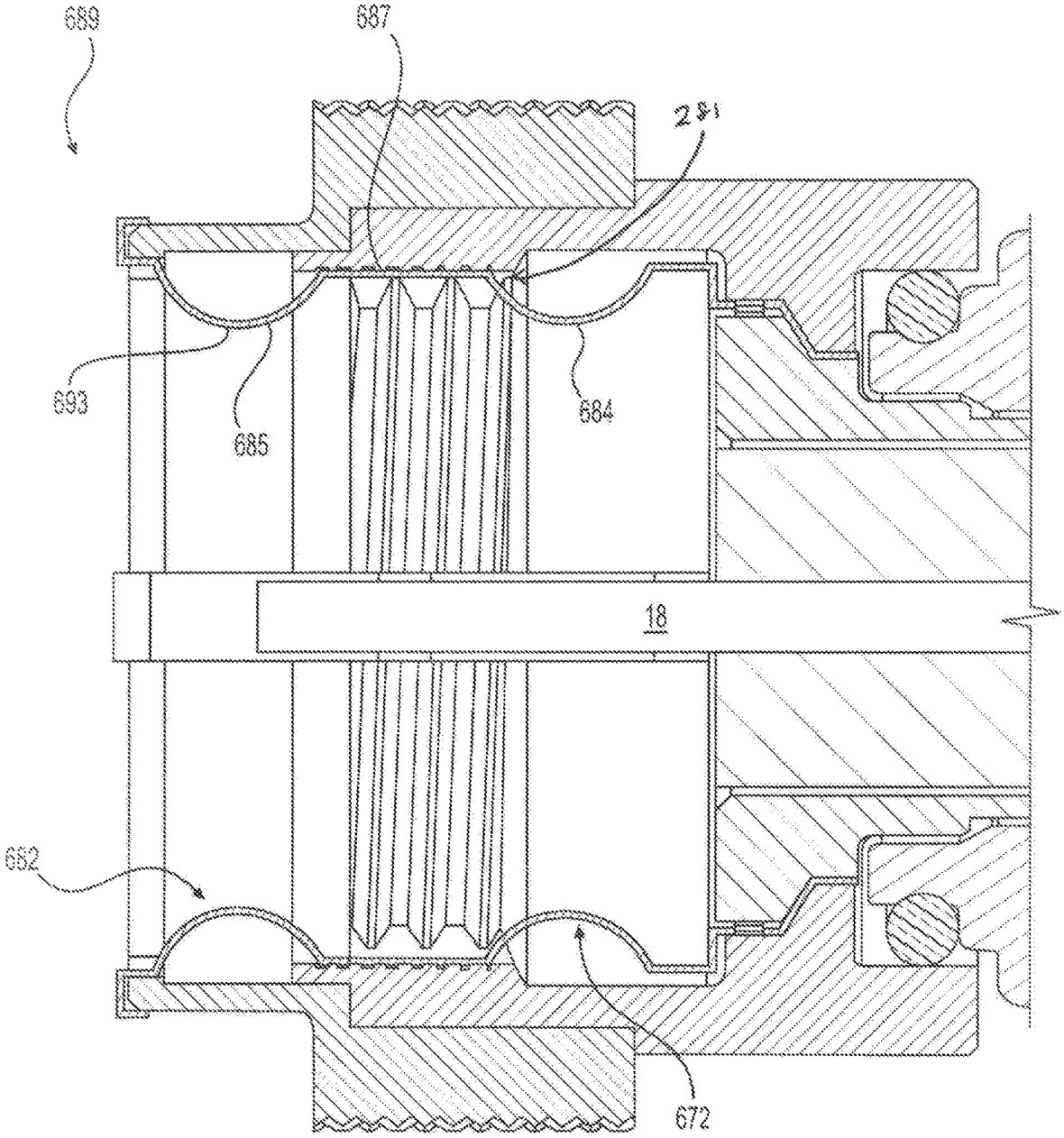
FIG. 6 is a side cross-sectional view of another exemplary conductive insert coupled with a coaxial connector.

Referring now to FIG. 6, a conductive insert 672 similar to the conductive insert 272 described above is illustrated. As shown in FIG. 6, the axial length of the second radially outermost portion 687 of the fingers 682 may be lengthened and the axial length of the first and second curved portions 684, 685 may be shortened such that a radially innermost portion 693 of the second curved portion 685 is moved toward the second end 689 of the conductive insert 672. As a result, the conductive insert 672 insures that the second curved portion 685 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 7:
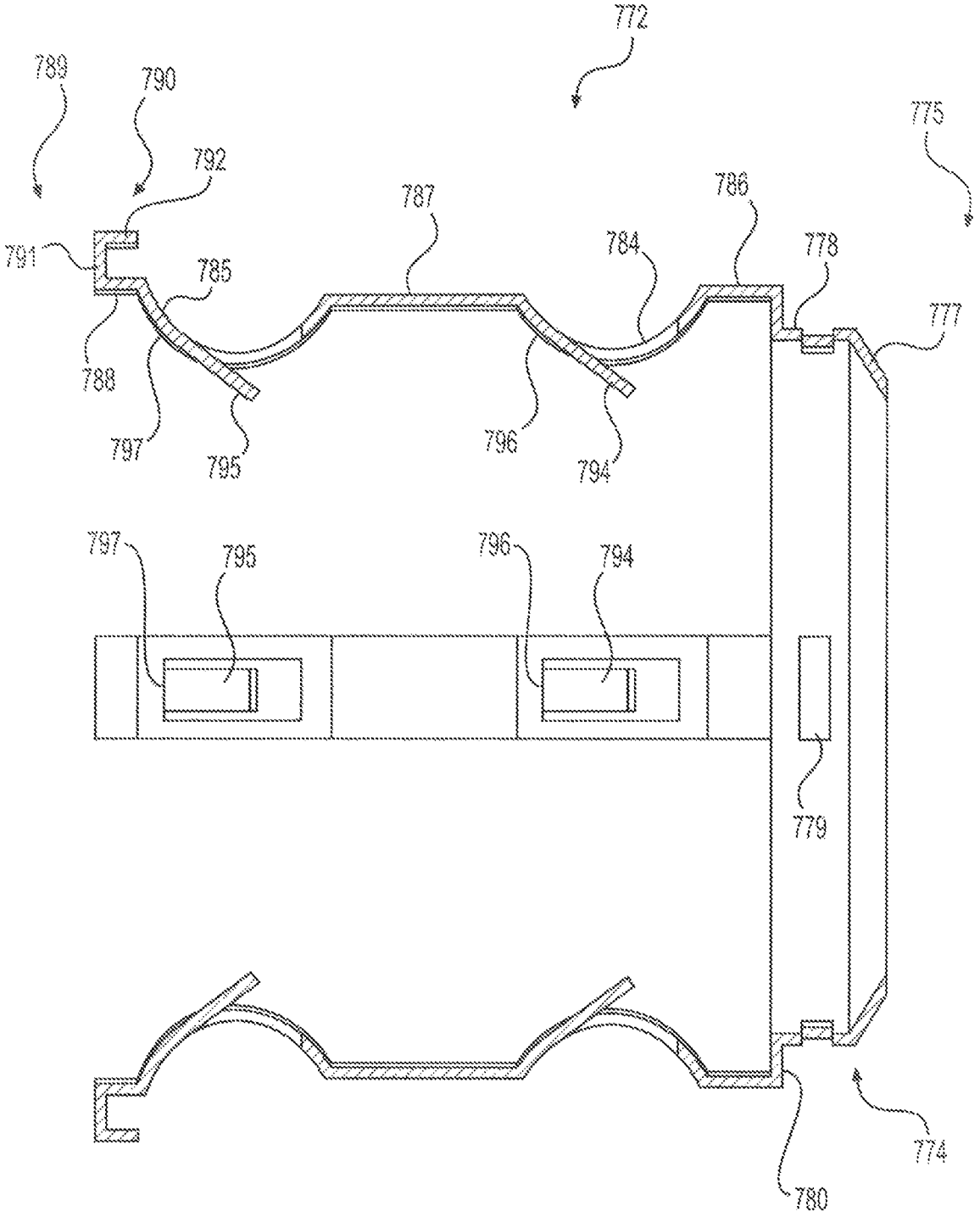
FIG. 7 is a side view of an exemplary conductive insert in accordance with various aspects of the disclosure.
Figure 8:
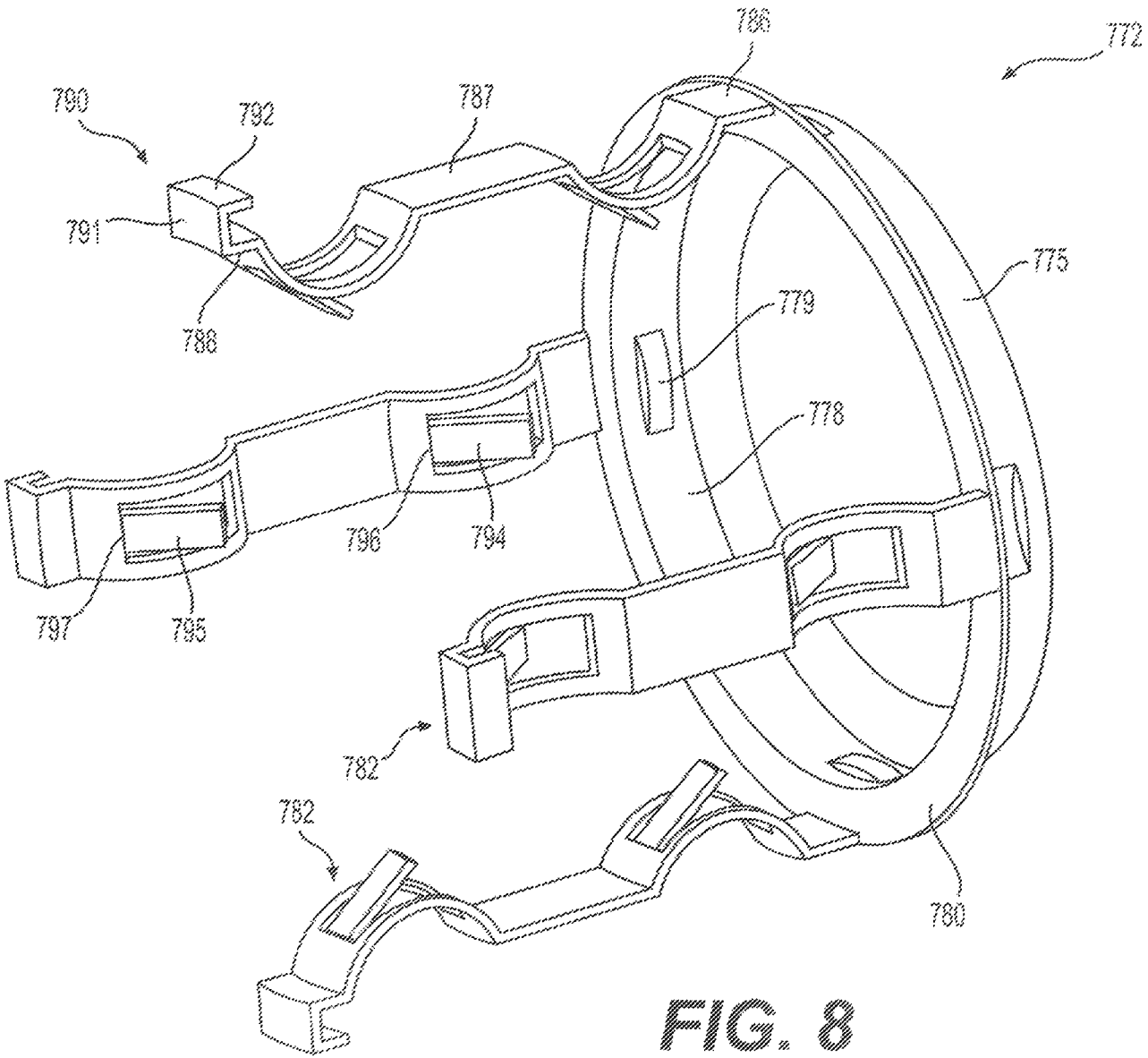
FIG. 8 is a side-front perspective view of the conductive insert of FIG. 7.
Figure 9:
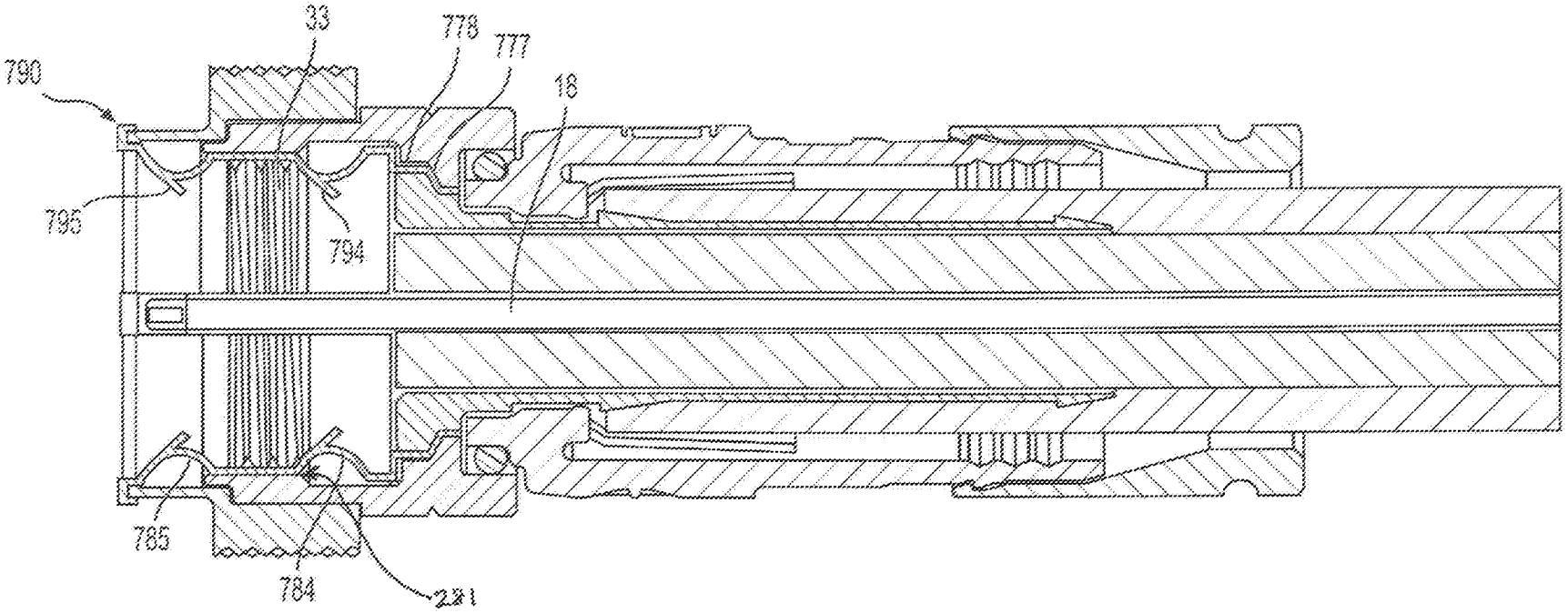
FIG. 9 is a side cross-sectional view of the conductive insert of FIG. 7 coupled with a coaxial connector.

Referring now to FIGS. 7-9, another exemplary conductive insert 772 in accordance with various aspects of the disclosure is illustrated. As shown in FIG. 7, the conductive insert 772 may have an annular ring-like portion 774 at a first end 775 that is shaped to match an inner profile of the lip 34 of the nut 30 and an outer profile of the flange 44 of the post 40. For example, the annular portion 774 may include a tapered portion 777, and a large diameter portion 778 that extends in an axial direction from an end of the tapered portion 777 opposite to the first end 775.

When installed with a connector, the large diameter portion 778 may be disposed between a radially inward facing surface of the nut 30 and a radially outward facing surface of the flange 44 of the post 40. Meanwhile, the transition portion 777 is between the forward facing surface 35 of the lip 34 of the nut 30 and the rearward facing surface 45 of the flange 44.

As best illustrated in FIG. 8, the large diameter portion 778 may include one or more resilient tabs 779 that are cut from the large diameter portion 778 and bend radially inward. For example, the tabs 779 remain connected to the large diameter portion 778 at their circumferential ends, but are separated from the large diameter portion 778 along their circumferential lengths. The tabs 779 are resilient such that when the large diameter portion 778 is disposed between a radially inward facing surface of the nut 30 and a radially outward facing surface of the flange 44 of the post 40, the tabs 779 provide a radial force against the radially outward facing surface of the flange 44, which urges the large diameter portion 778 radially outward against the radially inward surface of the nut 30.

A hoop portion 780 extends radially outward from an end of the large diameter portion 778 that is opposite to the transition portion 777. One or more fingers 782 extend from the hoop portion 780 in an axial direction away from the annular portion 774. According to various aspects of the disclosure, each of the fingers 782 includes two curved portions 784, 785 that curve radially inward from radially outermost portions 786, 787, 788 of the fingers 782. For example, in the illustrated embodiment, the first radially outermost portion 786 extends from the hoop portion 780 in the axial direction, and the first curved portion 784 extends from the first outermost portion 786 to the second radially outermost portion 787. The second curved portion 785 extends from the second outermost portion 787 to the third radially outermost portion 788.

As shown in FIGS. 7-9, each of the first and second curved portions 784, 785 includes a tab 794, 795 that extends radially inward from the respective curved portions 784, 785. The tabs 794, 795 are punched out of the curved portions 784, 785 such that the tabs 794, 795 are cantilevered at a forward end 796, 797 thereof. The tabs 794, 795 are resilient such that when the tabs engage the interface port 20, tabs 794, 795 provide a radial force against an outer surface 23 of the port 20 and are pushed outward by the port 20, thereby ensuring contact with the threaded surface 23 of the port 20. Also, as the nut 30 is coupled to the port 20, the tabs 794, 795 engage the threaded outer surface 23 of the port 20 and make it difficult for the nut 30 to be pulled off the port 20, even when the threads 33 of the nut 30 have not yet engaged the threaded outer surface 23 of the port 20.

A second end 789 of the conductive insert 772 includes a securing portion 790 formed by a radially extending portion 791 and an axially extending portion 792 that extends in the axial direction from the radially extending portion 791 toward the first end 775 of the conductive insert 772. With reference to FIG. 9, the each finger 782 is sized and arranged such that the third radially outermost portion 788 can extend beyond the forward end 31 of the nut assembly 30'. The radially extending portion 791 is structured and arranged to extend beyond an outer diameter of the forward end 31 of the nut assembly 30', and the axially extending portion 792 wraps back over the forward end 31 of the nut assembly 30'. The nut 30 may include a recess 783 arranged to receive a portion of the fingers 782 that may be pushed radially outward when the nut 30 is coupled with the interface port 20.

When assembled with a connector, for example, the connector 100, the first end 775 of the conductive insert 772 is secured to the nut assembly 30' and the post 40 by the matching profiles of the conductive insert 772, the nut assembly 30', and the post 40. The fingers 782 are secured to the forward end 31 of the nut assembly 30' by the securing portion 790. The securing portion 790 restricts axial movement of the fingers 782 relative to the nut assembly 30', while the one or more grooves 281 restrict rotation of the fingers 782 relative to the nut assembly 30'.

The first and second curved portions 784, 785 are structured and arranged to extend radially inward beyond threads of the internal threading 33 of the nut 30. Thus, when coupled with the threaded exterior surface 23 of the coaxial cable interface port 20, the first and second curved portions 784, 785 promote redundant contact, higher retention forces, and continuous grounding from the interface port 20 through to the post 40, even when loosely connected (i.e., not fully tightened) to the interface port 20. As shown in FIGS. 7-9, the axial length of the second radially outermost portion 787 of the fingers 782 may be lengthened and the axial length of the first and second curved portions 784, 785 may be shortened such that a radially innermost portion 793 of the second curved portion 785 is moved toward the second end 789 of the conductive insert 772, similar to the embodiment discussed above with reference to FIG. 6. As a result, the conductive insert 772 insures that the second curved portion 785 can make contact with the interface port 20 before the center conductor 18 in order to create a ground from the interface port 20 through to the post 40 and thus limit burst that would otherwise occur upon insertion of the center conductor 18 into the interface port 20 in the absence of a ground.

Figure 10:
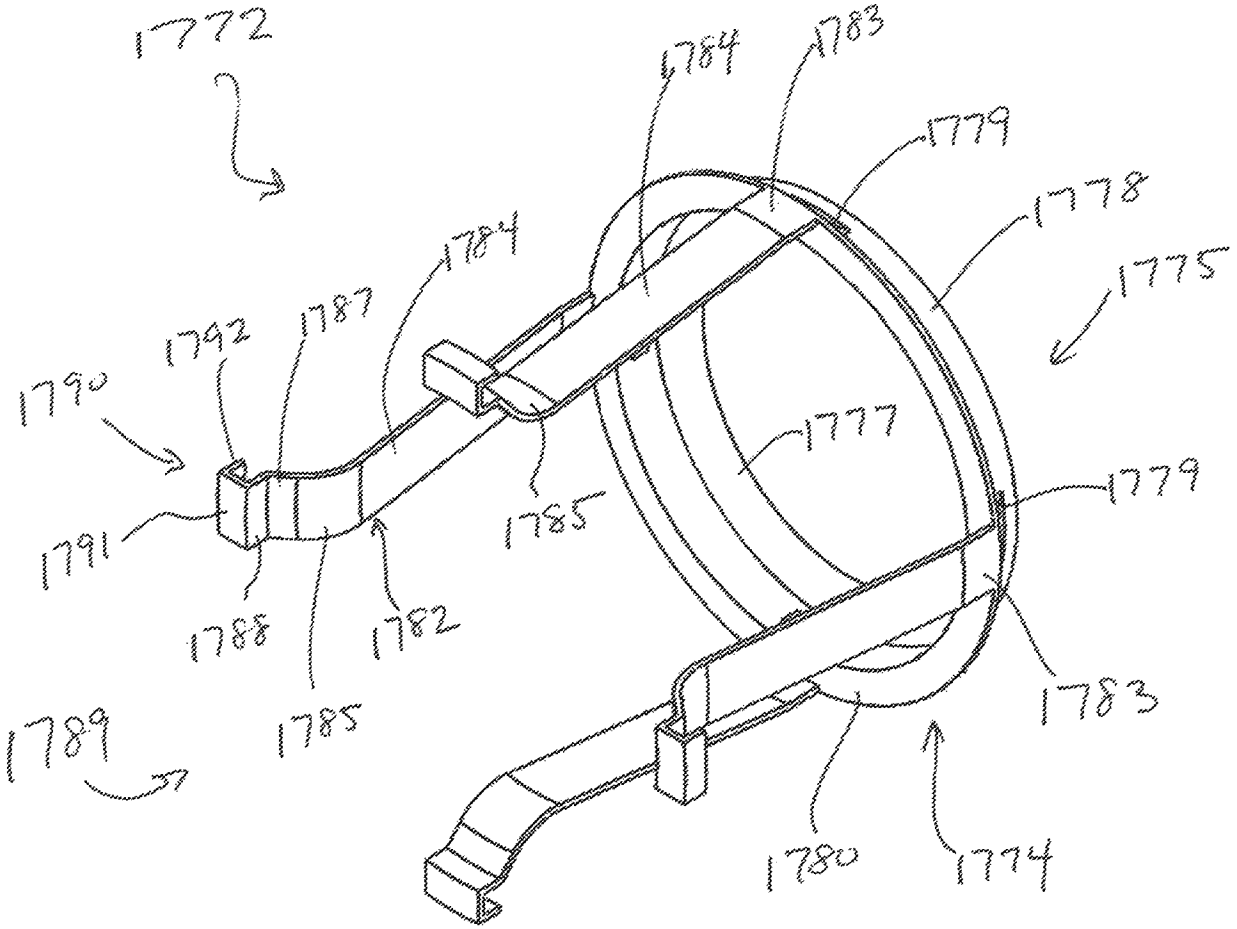
FIG. 10 is a side-front perspective view of an exemplary conductive insert in accordance with various aspects of the disclosure.
Figure 11:
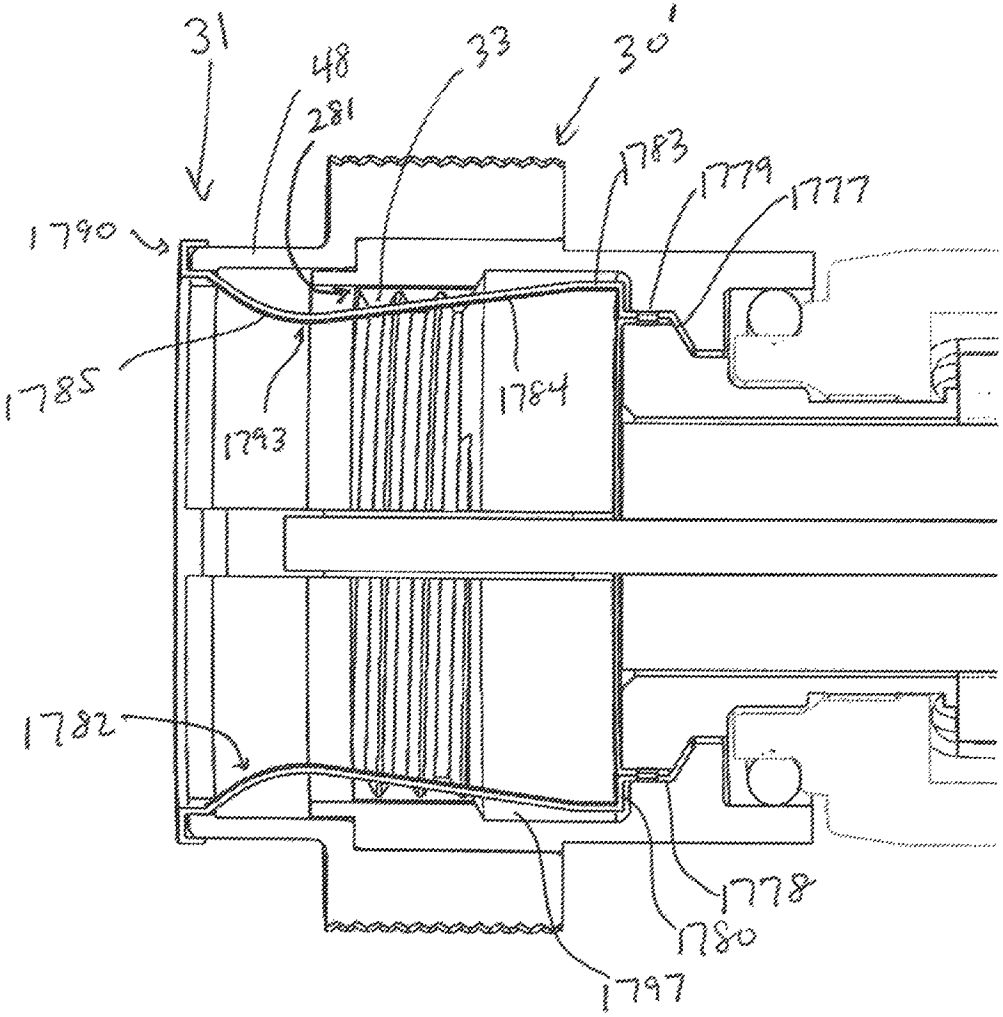
FIG. 11 is a side cross-sectional view of the conductive insert of FIG. 10 coupled with a coaxial connector.

Referring now to FIGS. 10 and 11, an exemplary conductive insert 1772 in accordance with various aspects of the disclosure is illustrated. As shown in FIG. 10, the conductive insert 1772 may have an annular ring-like portion 1774 at a first end 1775 that is shaped to match an inner profile of the lip 34 of the nut 30 and an outer profile of the flange 44 of the post 40. For example, the annular portion 1774 may include a tapered portion 1777, and a large diameter portion 1778 that extends in an axial direction from an end of the tapered portion 1777 opposite to the first end 1775.

When installed with a connector, the large diameter portion 1778 may be disposed between a radially inward facing surface of the nut 30 and a radially outward facing surface of the flange 44 of the post 40. Meanwhile, the transition portion 1777 is between the forward facing surface 35 of the lip 34 of the nut 30 and the rearward facing surface 45 of the flange 44. The large diameter portion 1778 may include one or more resilient tabs 1779 that are cut from the large diameter portion 1778 and bend radially inward. For example, the tabs 1779 remain connected to the large diameter portion 1778 at their circumferential ends, but are separated from the large diameter portion 1778 along their circumferential lengths. The tabs 1779 are resilient such that when the large diameter portion 1778 is disposed between a radially inward facing surface of the nut 30 and a radially outward facing surface of the flange 44 of the post 40, the tabs 1779 provide a radial force against the radially outward facing surface of the flange 44, which urges the large diameter portion 1778 radially outward against the radially inward surface of the nut 30.

A hoop member 1780 extends radially outward from an end of the large diameter portion 1778 that is opposite to the transition portion 1777. One or more fingers 1782 extend from the hoop member 1780 in an axial direction away from the annular portion 1774. According to various aspects of the disclosure, each of the fingers 1782 includes a first straight portion 1783 that extends axially from the hoop member 1780 to a second straight portion 1784. The second straight portion 1784 is angled radially inward relative to the first straight portion 1783 and extends from the first straight portion 1783 to a curved portion 1785 that bends radially outward toward a radially outermost portion 1788 of the respective finger 1782. In some aspects, the curved portion 1785 may be connected directly to the radially outermost portion 1788, while in other aspects, the curved portion 1785 may be connected to the radially outermost portion 1788 by a third straight portion 1787.

A second end 1789 of the conductive insert 1772 includes a securing portion 1790 formed by a radially extending portion 1791 and an axially extending portion 1792 that extends in the axial direction from the radially extending portion 1791 toward the first end 1775 of the conductive insert 1772. With reference to FIG. 11, the each finger 1782 is sized and arranged such that the radially outermost portion 1788 can extend beyond the forward end 31 of the nut 30. The radially extending portion 1791 is structured and arranged to extend beyond an outer diameter of the forward end 31 of the nut 30, and the axially extending portion 1792 wraps back over the forward end 31 of the nut 30. The nut 30 may include a recess 1797 arranged to receive a portion of the fingers 1782 that may be pushed radially outward then the nut 30 is coupled with the interface port 20.

When assembled with a connector, for example, the connector 100, the first end 1775 of the conductive insert 1772 is secured to the nut assembly 30' and the post 40 by the matching profiles of the conductive insert 1772, the nut assembly 30', and the post 40. The fingers 1782 are secured to the forward end 31 of the nut assembly 30' by the securing portion 1790. The securing portion 1790 restricts axial motion of the fingers 1782 relative to the nut assembly 30', while the one or more grooves 281 restrict rotation of the fingers 782 relative to the nut assembly 30'.

As illustrated in FIG. 11, the second straight portion 1784 and the curved portion 1785 are structured and arranged to extend radially inward beyond threads of the internal threading 33 of the nut 30. Also, the nut 30 may include an extension portion 48 that extends forward relative to the internal threading 33 of the nut 30 and relative to a forward end of the center conductor 18. Thus, a radially innermost portion 1793 of the second curved portion 1785 is forward of the internal threading 33 of the nut. As a result, the curved portion 1785 can make contact with the interface port 20 before the center conductor 18 in order to create a ground from the interface port 20 through to the post 40 and thus limit burst that would otherwise occur upon insertion of the center conductor 18 into the interface port 20 in the absence of a ground. Thus, when coupled with the threaded exterior surface 23 of the coaxial cable interface port 20, the second straight portion 1784 and the curved portion 1785 promote redundant contact, higher retention forces, and continuous grounding from the interface port 20 through to the post 40, even when loosely connected (i.e., not fully tightened) to the interface port 20. As a result, the conductive insert 1772 insures that the curved portion 1785 can make contact with the interface port 20 before the center conductor 18 when the connector 100 is coupled with the interface port 20 in order to create a ground from the interface port 20 through to the post 40 and thus limit burst that would otherwise occur upon insertion of the center conductor 18 into the interface port 20 in the absence of a ground.

Figure 12:
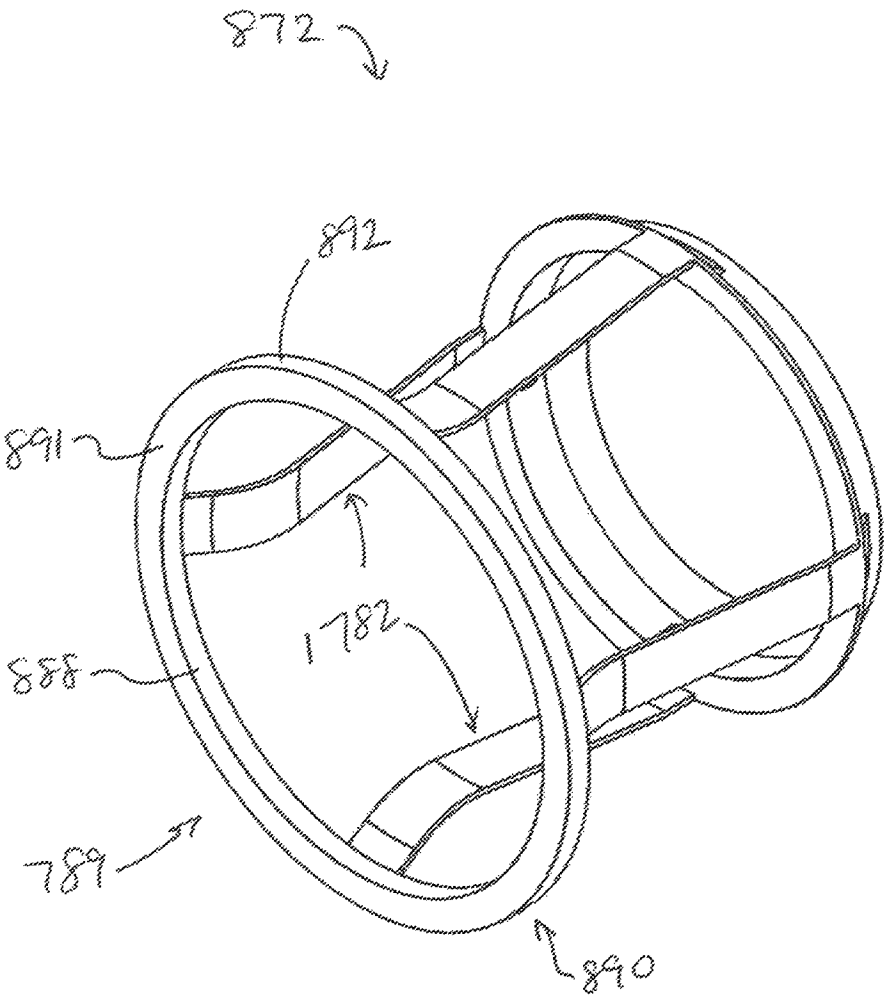
FIG. 12 is a side-front perspective view of another exemplary conductive insert in accordance with various aspects of the disclosure.
Figure 13:
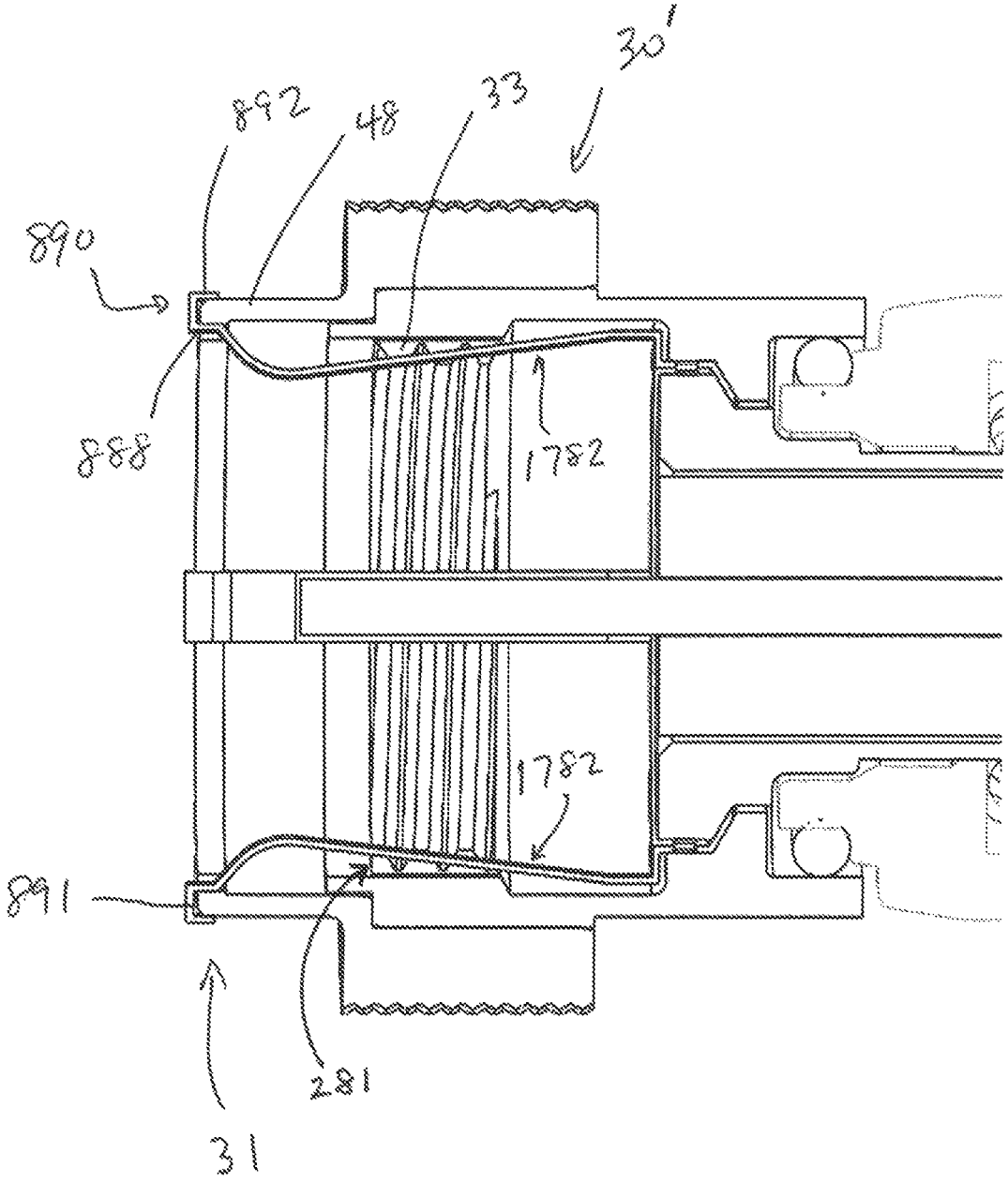
FIG. 13 is a side cross-sectional view of the conductive insert of FIG. 12 coupled with a coaxial connector.

Referring now to FIGS. 12 and 13, an exemplary conductive insert 872 in accordance with various aspects of the disclosure is illustrated. The conductive insert 872 is substantially the same as the conductive insert 1772 described above, except for the securing portion 890 at the second end 1789 of the conductive insert 872. The securing portion 890 is formed by an annular hoop portion 891 and an annular ring portion 892. The annular hoop portion 891 extends from a radially outermost ring portion 888 and has a radial length that is structured and arranged to extend beyond an outer diameter of the forward end 31 of the nut assembly 30'. The radially outermost ring portion 888 is coupled to each of the fingers 1782. The annular ring portion 892 extends axially from the annular hoop portion 891 so as to wrap back over the forward end 31 of the nut assembly 30'. The securing portion 890 restricts axial motion of the fingers 1782 relative to the nut assembly 30', while the one or more grooves 281 restrict rotation of the fingers 782 relative to the nut assembly 30'.

Figures 14, 15, 16:
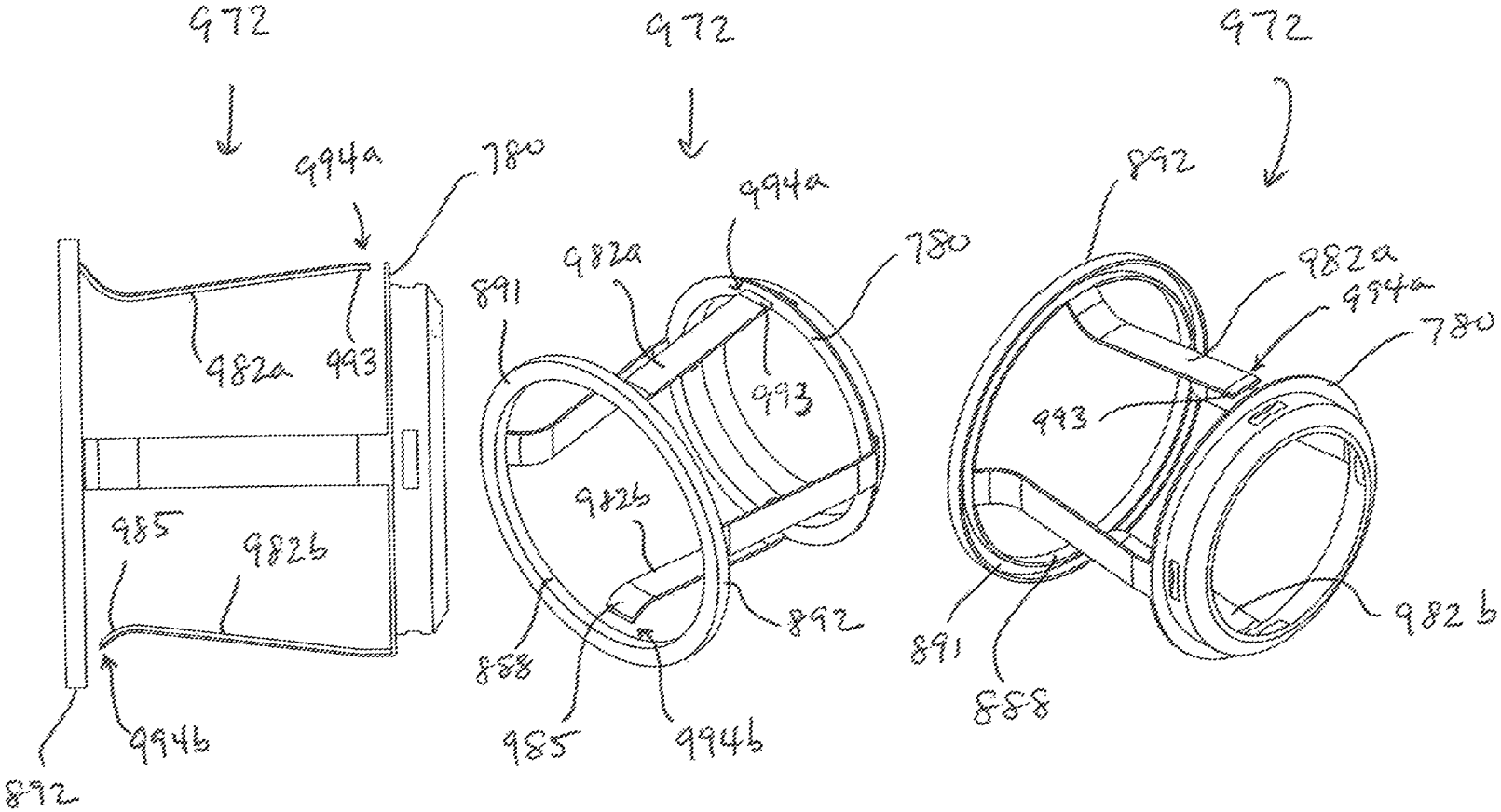
FIG. 14 is a side view of another exemplary conductive insert in accordance with various aspects of the disclosure.
FIG. 15 is a side-front perspective view of the conductive insert of FIG. 14.
FIG. 16 is a side-rear perspective view of the conductive insert of FIG. 14.

Referring now to FIGS. 14-16, an exemplary conductive insert 972 in accordance with various aspects of the disclosure is illustrated. The conductive insert 972 is substantially the same as the conductive insert 872 described above, except that one or more of the fingers 982*a*, 982*b* may have a free end 994*a*, 994*b* so as to be cantilevered. For example, one of the fingers 982*a* may have a free end 994*a* defined by a first straight portion 983 that is spaced from and not directly connected with the hoop member 780, and another one of the fingers 982*b* may have a free end 994*b* defined by a curved portion 985 that is spaced from and not directly connected with the radially outermost ring portion 888. These cantilevered fingers 982*a*, 982*b* may provide additional flexibility to facilitate coupling of the nut 30 with the interface port 20.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coaxial cable connector comprising:

a body configured to engage a coaxial cable having a conductive electrical grounding property;

a post configured to engage the body and the coaxial cable when the connector is installed on the coaxial cable;

a nut assembly configured to engage an interface port at a first retention force; and a conductive insert configured to be coupled with the nut assembly, wherein the conductive insert is configured to engage the interface port at a second retention force that is greater than the first retention force, wherein the conductive insert is configured to maintain electrical contact between the interface port and the nut assembly, even when the nut assembly is in a loosely tightened position on the interface port, wherein the conductive insert includes a first end having an annular ring-like portion configured to match an inner profile of the nut assembly and an outer profile of the post, wherein the nut assembly includes a nut portion and a nut cap extending about the nut portion, wherein the annular ring-like portion includes a tapered portion and a large diameter portion that extends in an axial direction from an end of the tapered portion, wherein the large diameter portion is configured to be disposed between a radially inward facing surface of the nut portion and a radially outward facing surface of the post, and the tapered portion is between the forward facing surface of the nut portion and the rearward facing surface of the post when installed with the connector, wherein a hoop portion extends radially outward from an end of the large diameter portion that is opposite to the tapered portion, wherein the conductive insert includes one or more fingers extending from the hoop portion in an axial direction away from the annular portion, wherein each of the one or more fingers includes a first straight portion that extends axially from the hoop member to a second straight portion, wherein the second straight portion is angled radially inward relative to the first straight portion and extends from the first straight portion to a curved portion that bends radially outward toward a radially outermost portion of the respective finger, wherein a second end of each of the one or more fingers includes a securing portion configured to secure the one or more fingers to a forward end of the nut assembly, wherein the securing portion is configured to restrict axial movement of the one or more fingers relative to the nut assembly, wherein the nut assembly includes one or more grooves configured to receive the second radially outermost portion of each of the one or more fingers, and wherein each of the one or more grooves is configured to restrict rotation of each of the one or more fingers relative to the nut assembly.

2. The coaxial cable connector of claim 1, wherein the curved portion is connected directly to the radially outermost portion.

3. The coaxial cable connector of claim 1, wherein the curved portion is connected to the radially outermost portion by a third straight portion.

4. The coaxial cable connector of claim 1, wherein one of the fingers has a free end defined by the curved portion being spaced from and not directly connected with the radially outermost ring portion such that the one of the fingers is cantilevered.

5. The coaxial cable connector of claim 1, wherein the securing portion is formed by an annular hoop portion and an annular ring portion, the annular hoop portion extending from a radially outermost ring portion and having a radial length that is structured and arranged to extend beyond an outer diameter of the forward end of the nut assembly, the radially outermost ring portion being coupled to each of the fingers.

6. The coaxial cable connector of claim 5, wherein the annular ring portion extends axially from the annular hoop portion and is configured to wrap back over the forward end of the nut assembly.

7. The coaxial cable connector of claim 1, wherein a first one of the fingers has a free end defined by the first straight portion being spaced from and not directly connected with the hoop member such that the first one of the fingers is cantilevered.

8. The coaxial cable connector of claim 7, wherein a second one of the fingers has a free end defined by the curved portion being spaced from and not directly connected with the radially outermost ring portion such that the second one of the fingers is cantilevered.

9. A coaxial cable connector comprising:

a body configured to engage a coaxial cable having a conductive electrical grounding property;

a post configured to engage the body and the coaxial cable when the connector is installed on the coaxial cable;

a nut assembly configured to engage an interface port at a first retention force; and a conductive insert configured to be coupled with the nut assembly, wherein the conductive insert includes one or more fingers extending from the hoop portion in an axial direction away from the annular portion, wherein the conductive insert is configured to engage the interface port at a second retention force that is greater than the first retention force, and wherein the conductive insert is configured to maintain electrical contact between the interface port and the nut assembly, even when the nut assembly is in a loosely tightened position on the interface port.

10. The coaxial cable connector of claim 9, wherein the conductive insert includes a first end having an annular ring-like portion configured to match an inner profile of the nut assembly and an outer profile of the post.

11. The coaxial cable connector of claim 9, wherein the nut assembly includes a nut portion and a nut cap extending about the nut portion.

12. The coaxial cable connector of claim 9, wherein one of the fingers has a free end defined by the curved portion being spaced from and not directly connected with the radially outermost ring portion such that the one of the fingers is cantilevered.

13. The coaxial cable connector of claim 9, wherein the nut assembly includes one or more grooves configured to receive the second straight portion of each of the one or more fingers, and wherein each of the one or more grooves is configured to restrict rotation of each of the one or more fingers relative to the nut assembly.

14. The coaxial cable connector of claim 9, wherein a first one of the fingers has a free end defined by the first straight portion being spaced from and not directly connected with the hoop member such that the first one of the fingers is cantilevered.

15. The coaxial cable connector of claim 14, wherein a second one of the fingers has a free end defined by the curved portion being spaced from and not directly connected with the radially outermost ring portion such that the second one of the fingers is cantilevered.

16. The coaxial cable connector of claim 9, wherein the annular ring-like portion includes a tapered portion and a large diameter portion that extends in an axial direction from an end of the tapered portion, wherein the large diameter portion is configured to be disposed between a radially inward facing surface of the nut portion and a radially outward facing surface of the post, and the tapered portion is between the forward facing surface of the nut portion and the rearward facing surface of the post when installed with the connector.

17. The coaxial cable connector of claim 16, wherein a hoop portion extends radially outward from an end of the large diameter portion that is opposite to the transition portion.

18. The coaxial cable connector of claim 17, wherein each of the one or more fingers includes a first straight portion that extends axially from the hoop member to a second straight portion, wherein the second straight portion is angled radially inward relative to the first straight portion and extends from the first straight portion to a curved portion that bends radially outward toward a radially outermost portion of the respective finger, wherein a second end of each of the one or more fingers includes a securing portion configured to secure the one or more fingers to a forward end of the nut assembly, and wherein the securing portion is configured to restrict axial movement of the one or more fingers relative to the nut assembly.

19. The coaxial cable connector of claim 18, wherein the securing portion is formed by an annular hoop portion and an annular ring portion, the annular hoop portion extending from a radially outermost ring portion and having a radial length that is structured and arranged to extend beyond an outer diameter of the forward end of the nut assembly, the radially outermost ring portion being coupled to each of the fingers.

20. The coaxial cable connector of claim 19, wherein the annular ring portion extends axially from the annular hoop portion and is configured to wrap back over the forward end of the nut assembly.

* * * * *